United States Patent [19]

Pollock et al.

[11] 4,281,583

[45] Aug. 4, 1981

[54] AMMUNITION SUPPLY SYSTEM

[75] Inventors: Stephen F. Pollock; Charles E. Benedict, both of Tallahassee, Fla.

[73] Assignee: Wayne H. Coloney Company, Inc., Tallahassee, Fla.

[21] Appl. No.: 2,122

[22] Filed: Jan. 9, 1979

[51] Int. Cl.[3] ..... F42B 39/12

[52] U.S. Cl. ..... 89/33 BB; 89/34; 414/403

[58] Field of Search ..... 86/48; 89/33 BB, 33 BC, 89/33 CA, 33 ML, 12

[56] References Cited

U.S. PATENT DOCUMENTS

| | | | |
|---|---|---|---|
| 173,751 | 2/1876 | Bailey | 89/33 BC |
| 323,997 | 8/1885 | Allender | 89/33 CA |
| 2,413,316 | 12/1946 | Freeman | 86/48 |
| 2,432,398 | 12/1947 | Edson et al. | 86/48 |
| 2,638,029 | 5/1953 | Boehmer | 86/48 |
| 3,380,392 | 4/1968 | Chiabrandy | 89/33 MC |
| 3,696,704 | 10/1972 | Backus et al. | 89/34 |
| 3,983,782 | 10/1976 | Sawyer | 89/33 CA |
| 4,036,102 | 7/1977 | Marrotte et al. | 89/33 BB |
| 4,044,649 | 8/1977 | Wilder | 89/33 BB |
| 4,068,557 | 1/1978 | Montjallard et al. | 89/33 E |
| 4,074,610 | 2/1978 | Lock et al. | 89/34 |
| 4,137,820 | 2/1979 | Clemens | 89/34 |

*Primary Examiner*—Stephen C. Bentley
*Attorney, Agent, or Firm*—Dowell & Dowell

[57] ABSTRACT

An ammunition supply system including a vehicle having a fluted drum which receives an ammunition belt including a plurality of interconnected tubular members each of which carries a round of ammunition of a size in the range of 20 mm to 40 mm. Within the vehicle, the shells are removed from the tubular members while the belt is on the drum and such shells are transferred to a feed belt which carries the rounds of ammunition to an armament system. Simultaneously, empty shell casings and misfired rounds are returned from the armament system and are inserted into the tubular members of the ammunition belt while such tubular members remain on the drum. Thereafter, the ammunition belt is discharged from the vehicle into a receptacle.

3 Claims, 11 Drawing Figures

AMMUNITION SUPPLY SYSTEM

SUMMARY OF THE INVENTION

In recent years, military technology has increased significantly so that certain present day armament systems employ "Gatling" type or other rapid fire cannons which use shells having a caliber of 20 mm to 40 mm. The gun and the accompanying armament system may have an ammunition capacity of approximately 400 to 1350 rounds per minute. Because of such capacity and rate of fire, a significant problem has arisen in replenishing the armament system in a minimum of time so that such system is not delayed unnecessarily. During the replenishing operation, all of the spent shell casings and misfired rounds of ammunition are removed from the armament system and replaced with live rounds of ammunition, preferably within the time required to service the armament system. Also, it is sometimes necessary to replace the entire complement of ammunition of the armament system. As an example, the armament system may be equipped with high explosive ammunition when it becomes apparent that a different type of ammunition such as armor piercing ammunition must be used. When this occurs, it is necessary to download most or all of the high explosive ammunition and replace the same with a different type.

It is noted that in this application the term "round of ammunition" or "shell" is intended to mean an ammunition unit having a casing which contains an explosive charge and a projectile. The term "shell casing" is intended to means the portion of the round of ammunition which remains after the explosive charge has been ignited and the projectile has been fired through the gun. The term "misfired round" is intended to mean a round of ammunition which has been inserted within the breech of the gun and its firing attempted unsuccessfully. The term "unfired round" is intended to mean a round of ammunition whose firing has not been attempted.

The present invention relates to ammunition handling systems and is embodied particularly in a handling system for supplying ammunition to an armament system while simultaneously removing shell casings and misfired rounds therefrom. If desired, the type of ammunition in the armament system may be replaced by downloading the type of ammunition already in such system while simultaneously uploading a selected type of ammunition or a combination of types into the armamemt system.

The supply system of the present invention includes a vehicle having a housing within which a fluted drum is rotatably mounted in a position to receive an ammunition belt from a container and such belt includes a multiplicity of interconnected tubular members each of which contains a shell or round of ammunition. Within the housing a rear interface unit receives the belt from a supply area and places the tubular members in the recessed grooves or flutes of the drum. Thereafer the shells or rounds of ammunition are separated from the tubular members during a portion of the rotation of the drum and a front interface unit removes the shells from the drum and places the same on an ammunition feed belt or conveyor leading to the armament system while the tubular members remain on the drum. The feed belt carries the rounds of ammunition past an inspection station to an interface unit or load head located adjacent to the armament system. At the load head the rounds of ammunition are transferred to the armament system, while empty shell casings and misfired rounds are removed therefrom and placed onto the feed belt. The shell casings, misfired rounds and, if desired, unfired rounds are returned to the housing where the front interface unit places the same onto the drum, after which they are inserted into the tubular members and the ammunition belt is subsequently returned to an empty receptacle. If desired, the housing may be provided with an armored receptacle into which misfired rounds may be placed. In this event, one or more sensors are located adjacent to the feed belt return and a discharge mechanism may be provided to remove the misfired rounds from the belt and direct them into the armored receptacle.

It is an object of the invention to provide an ammunition supply system including a vehicle having means for receiving an ammunition belt having a multiplicity of tubular members each of which has a shell or round of ammunition therein, and placing such belt on a drum having means for removing the shells from the tubular members and subsequently transferring the shells to a point of use while simultaneously receiving used shell casings therefrom and inserting such casings into the tubular members after which the ammunition belt is discharged into a storage area.

DESCRIPTION OF THE PREFERRED EMBODIMENT

With continued reference to the drawings, the ammunition supply system of the present invention includes a vehicle 20 having a chassis or frame 21 supported by ground-engaging wheels 22. Such vehicle may be propelled and steered in any conventional manner (not shown) such as by a self-contained power plant, by a separate propelling vehicle, or by an elongated tongue which may be pulled by several people.

Figure 2:
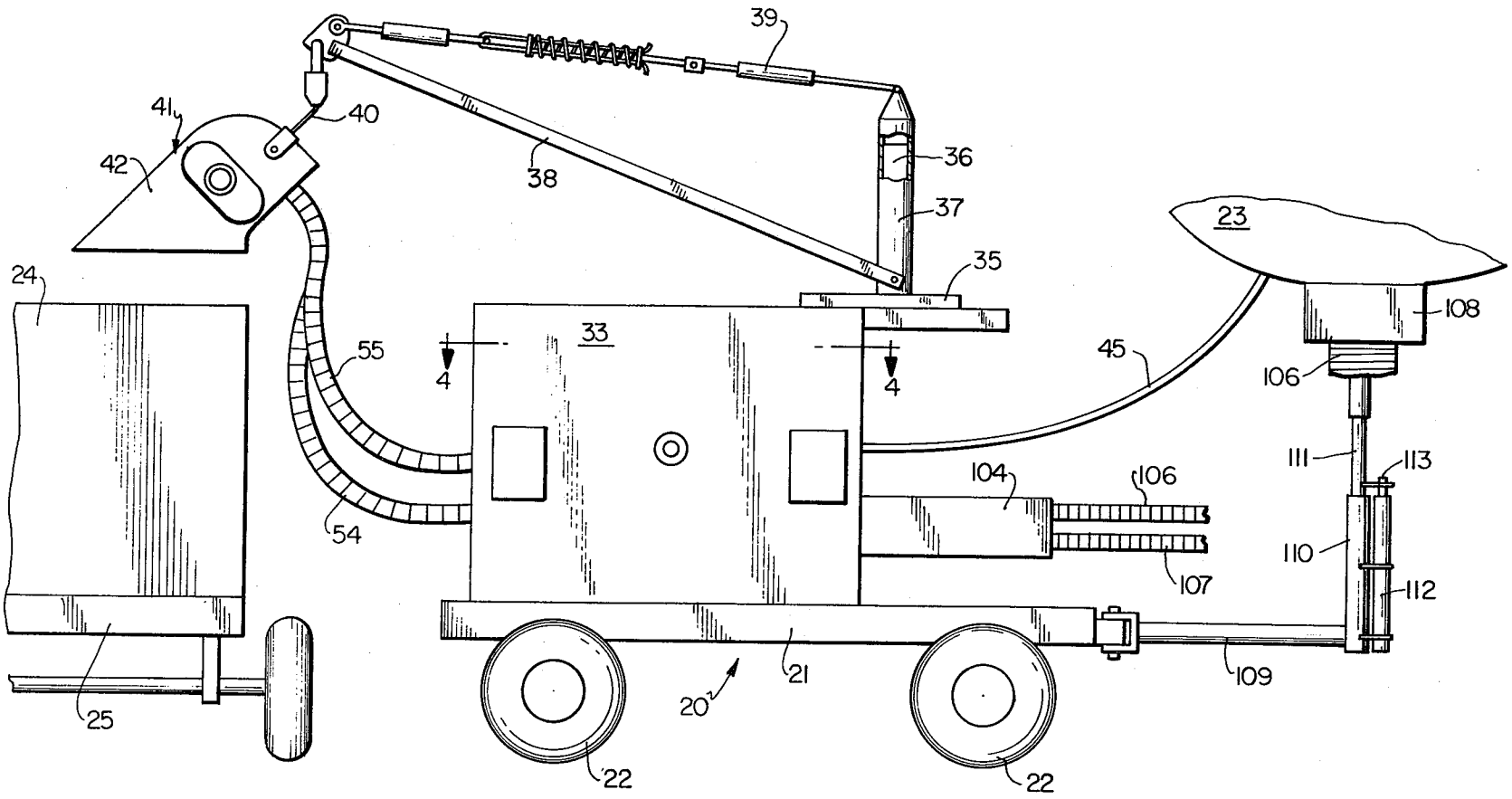
FIG. 2 is a side elevational view thereof.
Figure 11:
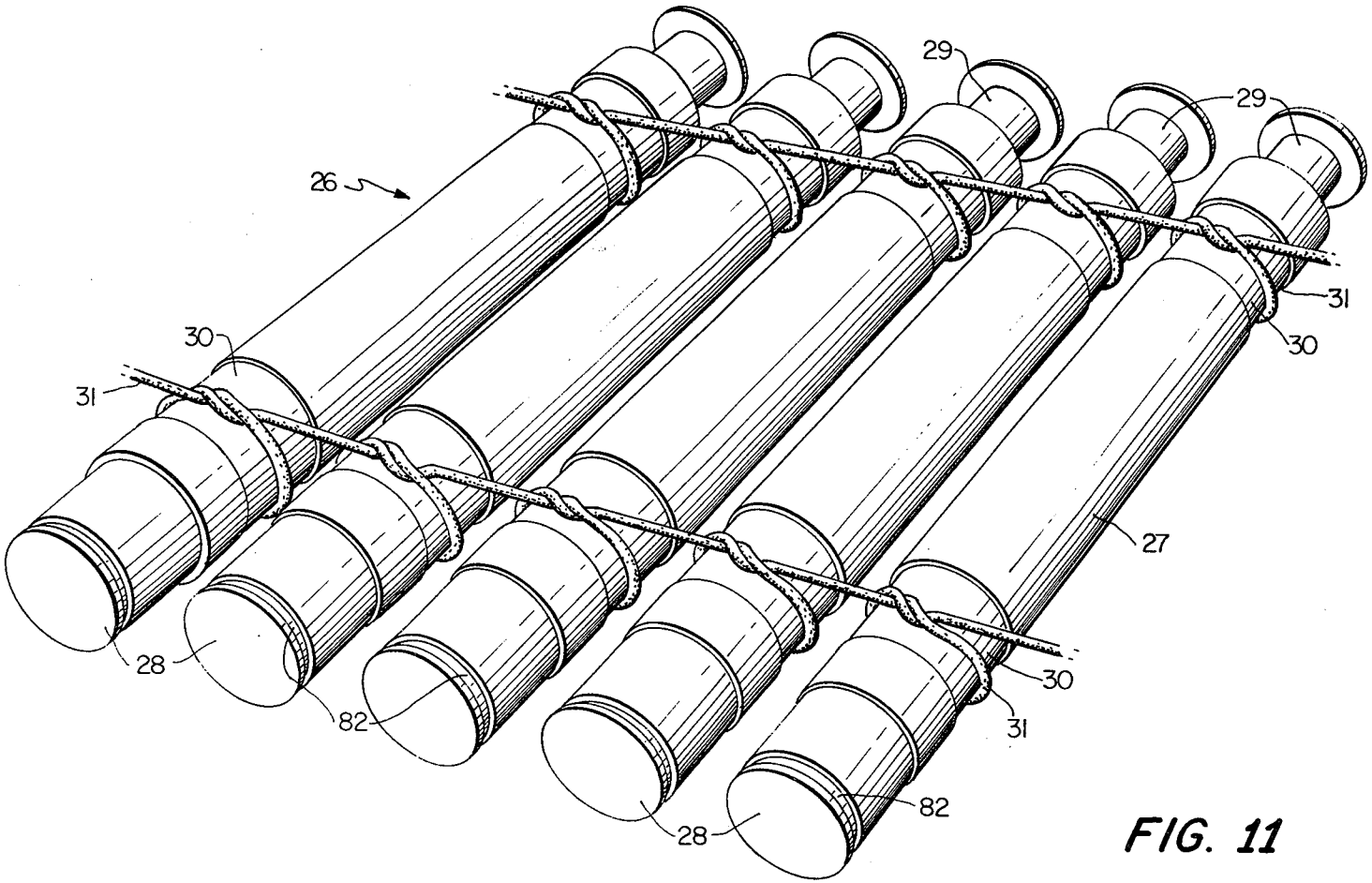
FIG. 11 is a perspective view of a portion of the ammunition belt.

The vehicle 20 is moved to a position adjacent to an armament system such as a military aircraft 23 (FIG. 2) and an ammunition supply, which normally includes at least two ammunition boxes or containers 24, is moved to a position adjacent to the rear end of the vehicle 20. If desired, the supply of ammunition may include a transport vehicle 25 on which a plurality of ammunition containers are mounted. One of the containers 24 normally is empty while the remaining containers are filled with ammunition carried by an elongated belt 26 of indefinite length. It is not essential that the containers 24 be in parallel abutting relationship with each other, however, such containers should be in proximity to each other. As illustrated best in FIG. 11, each ammunition belt 26 includes a plurality of tubular members 27 of a size to receive a shell or round of ammunition 28 of an appropriate caliber such as 20 mm to 40 mm. Each tubular member includes a relatively deep cam engaging groove 29 adjacent to one end and includes a pair of relatively shallow annular grooves 30 intermediate its ends. The annular grooves 30 receive loops or closed bands 31 of flexible substantially non-stretchable material and preferably such loops ordinarily are interwined with each other at each tubular member. Each of the loops includes a semicircular portion at each end which is disposed partially around one of the tubular members and such semicircular portions are joined by connecting portions which extend to an adjacent tubular member in such a manner that the tubular members are in spaced generally parallel relationship with each other. However, due to the flexibility of the loops, such tubular members may be moved toward each other to provide slack in the loops after which such tubular members may be moved axially a limited amount relative to each other for a purpose which will be described later.

In order to remove the ammunition belt 26 from a container 24, a main housing 33 is mounted on the frame of the vehicle 20. A platform 34 is mounted on top of the main housing and such platform is movably mounted in any described manner as by rollers or the like within tracks 35 to permit the platform to be moved longitudinally of the vehicle. An upright post 36 is fixed to the central portion of the platform 34 and rotatably receives a sleeve 37 on which a boom 38 is pivotally mounted. The boom 38 normally is of a length such that the outer end (or end remote from the sleeve 37) extends beyond the rear end of the housing 33. An adjustable support arm 39 having a resilient portion intermediate its ends connects the outer end of the boom 38 to the upper end of the sleeve 37 to permit limited vertical movement of the outer end of the boom. Such outer end of the boom 38 is connected by a link 40 to a container interface unit 41 so that such container interface unit may be located above and in spaced relationship to a pair of ammunition boxes 24.

Figure 5:
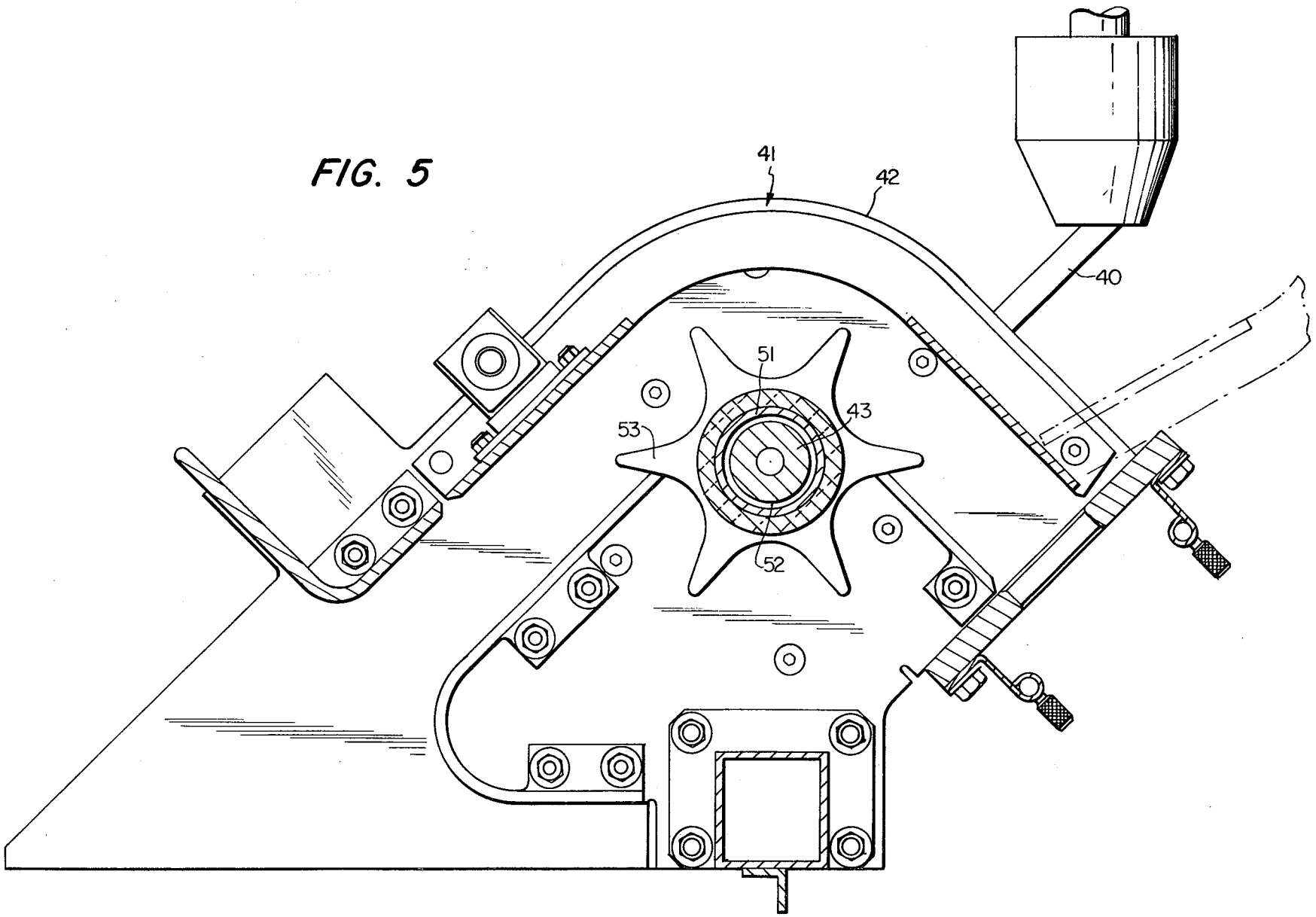
FIG. 5 is an enlarged sectional view taken on the line 5–5 of FIG. 3.
Figure 6:
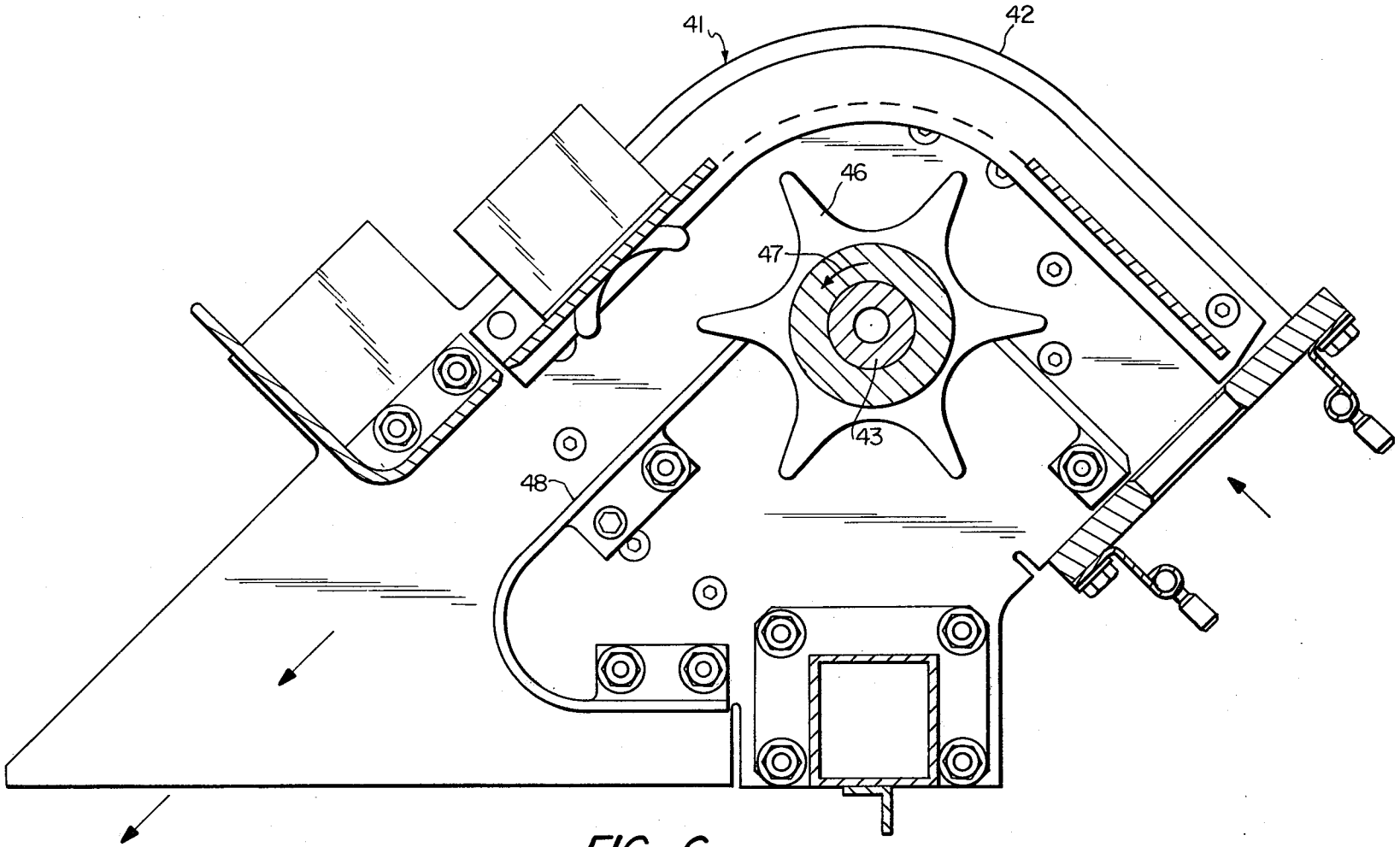
FIG. 6 is an enlarged sectional view taken on the line 6–6 of FIG. 3.
Figure 7:
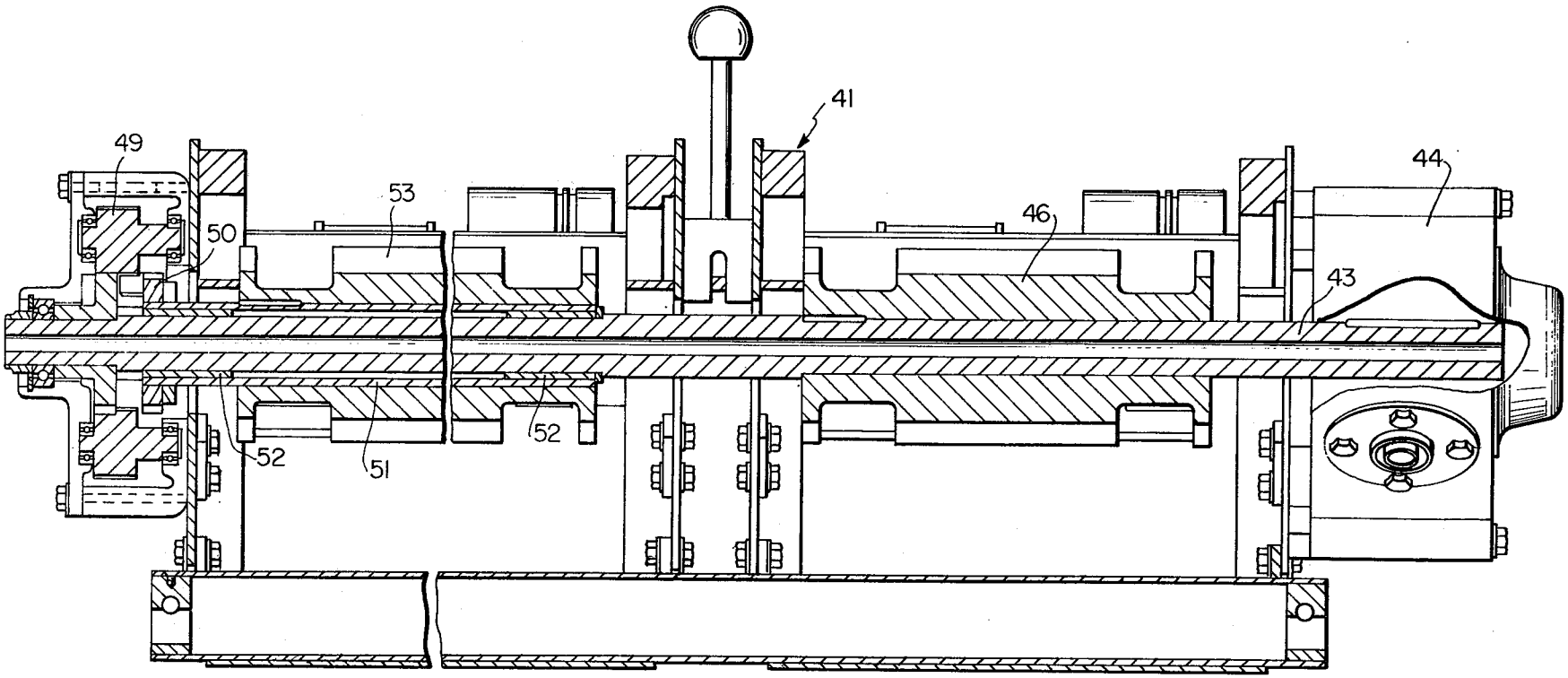
FIG. 7 is an enlarged fragmentary sectional view taken on the line 7–7 of FIG. 3.

With particular reference to FIGS. 5–7, the container interface unit 41 includes a housing 42 having a shaft 43 extending transversely across the same and generally centrally thereof. One end of the shaft 43 is drivingly connected to a gear box 44 which is driven by a flexible shaft 45 from any convenient source of power such a power plant on the aircraft 23. Within the housing 42, a first belt drive wheel 46 is located adjacent to one side of the housing and is keyed or otherwise attached to the shaft 43 so that when the shaft is driven in the direction of the arrow 46 (FIG. 6), the ammunition belt 26 is pulled from the main housing 33 and is discharged along an inclined wall 48 into an empty ammunition box or container 24.

The end of the shaft 43 remote from the gear box 44 is keyed or otherwise attached to a reversing gear mechanism 49 which meshes with a driven gear 50 carried by a sleeve 51. The sleeve 51 is rotatably mounted on the shaft 43 by low friction bearings 52 and the outer periphery of such sleeve is keyed or otherwise attached to a second belt drive wheel 53. An ammunition belt 26 is threaded onto the belt drive wheel 53 from the filled ammunition box 24 so that the belt is removed from the box by such wheel. It is noted that the belt drive wheels 46 and 53 rotate in opposite directions at substantially the same speed so that the belt is removed from one ammunition box and passes through the housing 33 after which such belt is discharged into another ammunition box in a manner which will be described later.

Figure 1:
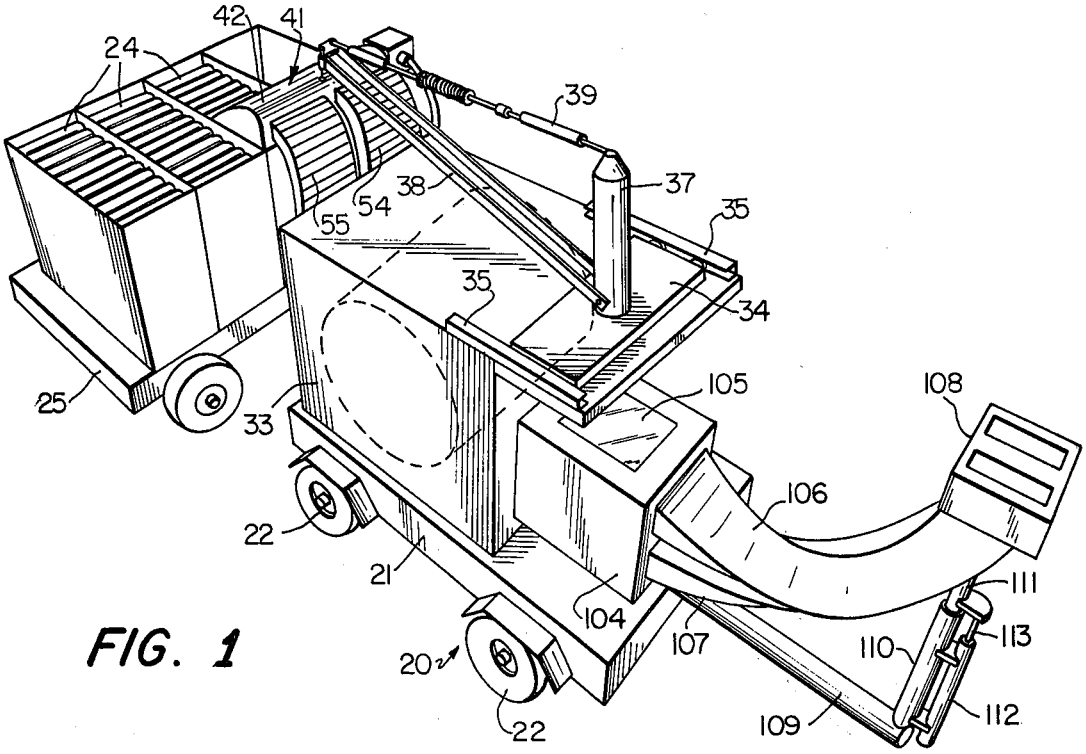
FIG. 1 is a perspective view illustrating one embodiment of the invention.
Figure 3:
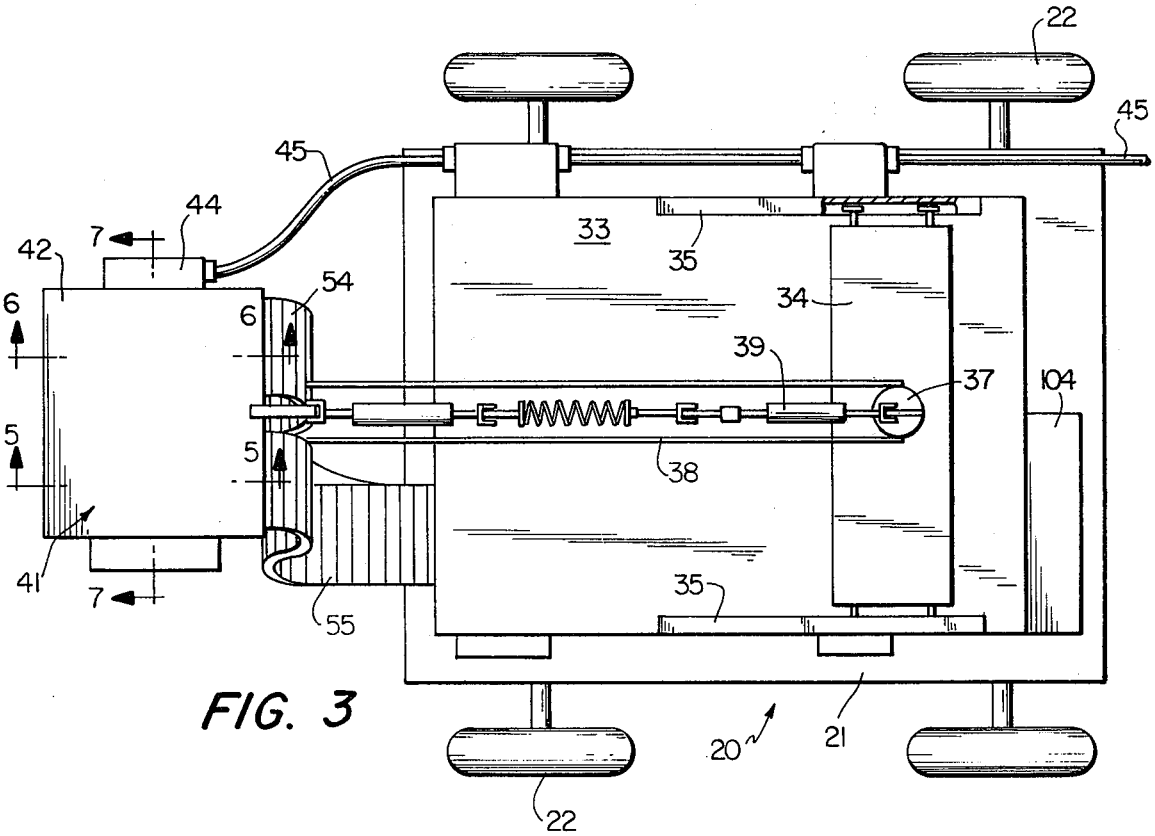
FIG. 3 is a top plan veiw.

A pair of flexible chutes 54 and 55 are connected in side-by-side relationship to the container interface unit 41 with the flexible chute 54 being substantially in alignment with the belt drive wheel 46 and the flexible chute 55 being substantially in alignment with the belt drive wheel 53. As illustrated best in FIGS. 2 and 3, the flexible chutes 54 and 55 curve downwardly from a position in side-by-side relationshiop on the container interface unit 41 to a position in which the flexible chute 55 is located above and in spaced relationship to the flexible chute 54 and both chutes are connected to the rear wall of the main housing 33.

Within the main housing 33 a rear interface unit 58 is provided substantially in alignment with the flexible chutes 54 and 55. Such rear interface unit includes a pair of side walls 59 each of which is provided with a groove 60 having straight and curved portions in the upper portion of each side wall and such groove is substantially in alignment with an opening 61 in the rear wall of the housing 33. The inlet chute 55 is attached to the rear wall of the housing in alignment with the opening 61 so that the ammunition belt 26 passing through the flexible chute is discharged from the chute into the groove 60. Additionally a groove 62 having straight and curved portions is provided in each of the side walls 59 in spaced relationship to the grooves 60 and each of the grooves 62 is generally in alignment with an opening 63 in the rear wall of the housing 33. The flexible chute 54 is attached to the rear wall of the housing substantially in alignment with the opening 63 and is adapted to receive an ammunition belt from the housing.

Figure 8:
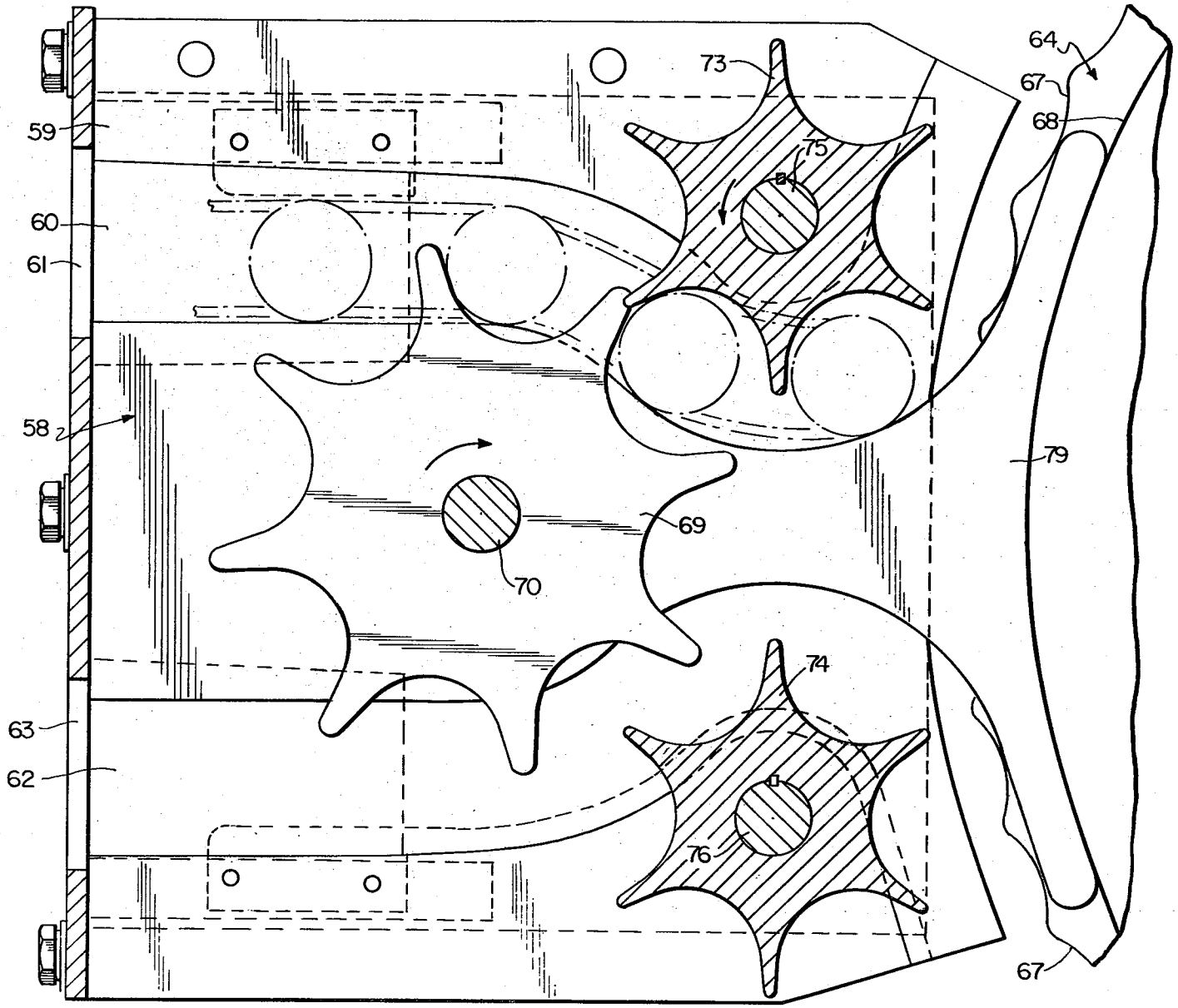
FIG. 8 is an enlarged sectional view taken on the line 8–8 of FIG. 4 and disclosing the rear interface unit.

A drum 64 having a relatively large diameter is rotatably mounted on a shaft 65 within the housing 33 and such drum may be driven in any desired manner from a convenient power plant such as a gear box 66 driven by the flexible shaft 45 from the aircraft power plant. Such drum includes a plurality of continguous flutes or cradles 67 extending from side to side thereof and preferably several annular grooves 68 are disposed about the periphery of the drum adjacent to one end. In order to transfer the ammunition belt from the upper portion of the rear interface unit 58 to the drum 64 and from the drum to the lower portion of the rear interface unit, such rear interface unit includes a drive sprocket 69 mounted on a shaft 70 rotatably carried by the side walls 59. As illustrated best in FIG. 8, the drive sprocket 69 is of a size to extend between the grooves 60 and 62 in the side walls 59.

The shaft 70 of the rear interface unit 58 is driven by a gear train 71 connected to a gear box 72 which in turn is driven from a convenient source of power such as the flexible shaft 45. The drive sprocket 69 pulls the belt 26 through the chute 55 substantially at a fixed speed with the loops 31 which connect the tubular members being spaced apart a predetermined distance. A pair of upper and lower star wheels 73 and 74 are mounted on shafts 75 and 76, respectively, within the rear interface unit 58. One end of each of the shafts 75 and 76 is provided with a gear 77 which meshes with a gear 78 affixed to the shaft 70 so that rotation of the shafts 75 and 76 and the star wheels 73 and 74 carried thereby are synchronized with the rotation of the drive sprocket 69. The upper star wheel 73 is positioned to remove the tubular members 27 of the belt from the drive sprocket, while such tubular members are guided by the grooves 60. The teeth of such upper star wheel are closer together than the teeth of the drive sprocket so that the distance between the tubular members 27 is reduced after the tubular members are removed from the drive sprocket which provides slack in the loops 31.

Each of the side walls 59 of the rear interface unit is provided with an outwardly extending Y-shaped head and the outwardly extending arms of such head are disposed within the annular grooves 68 of the drum 64. As illustrated best in FIG. 8, the Y-shaped head forms an extension of the inner surfaces of the grooves 60 and 62 so that the head functions as a guide member for transferring the tubular members to the flutes or cradles of the drum. It is noted that the speed of rotation of the drum is synchronized with the rotation of the upper star wheel so that one of the tubular members 27 is placed in each flute 67 of the drum with the loops 31 being slack.

Figure 4:
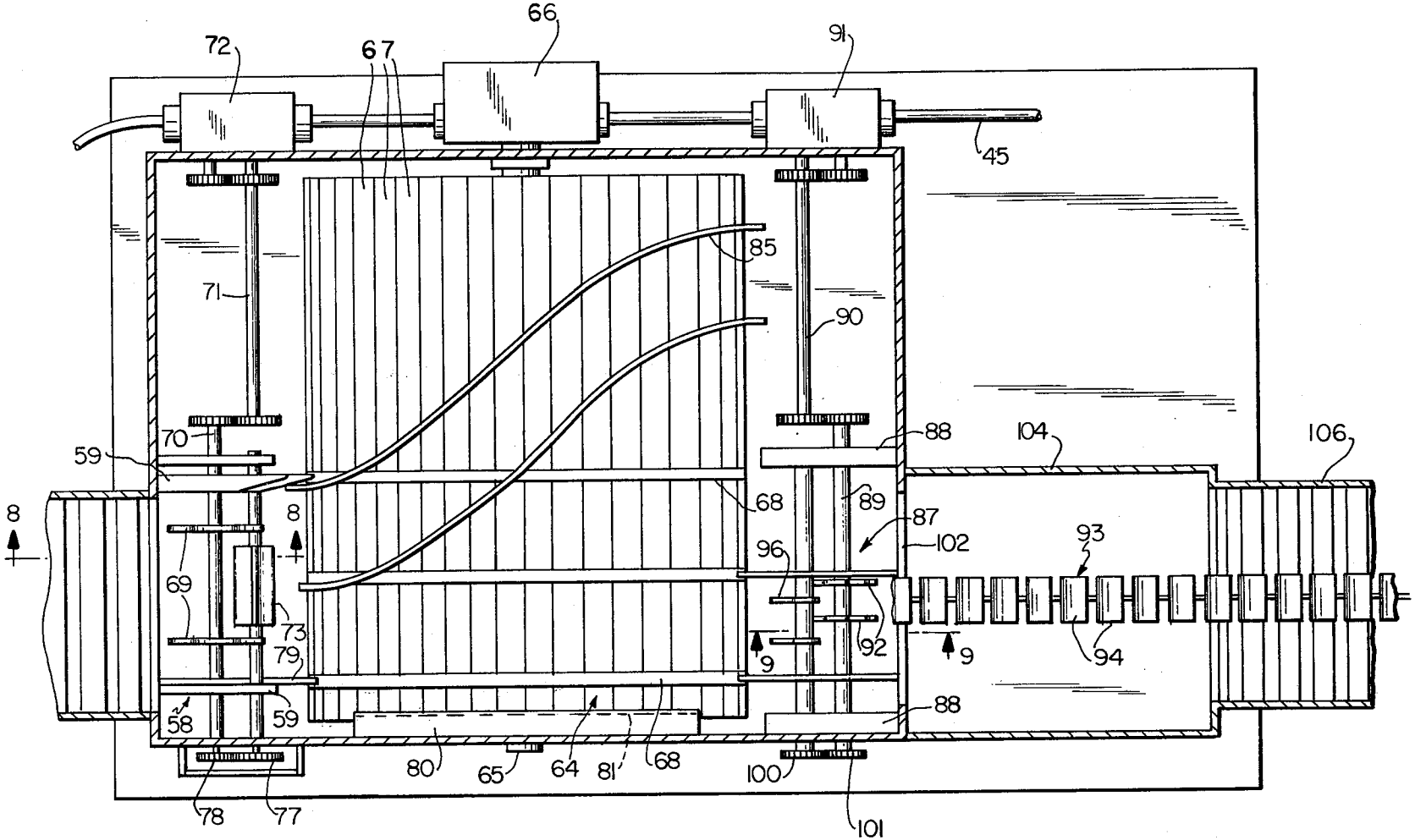
FIG. 4 is an enlarged sectional view taken on the line 4–4 of FIG. 2.
Figure 10:
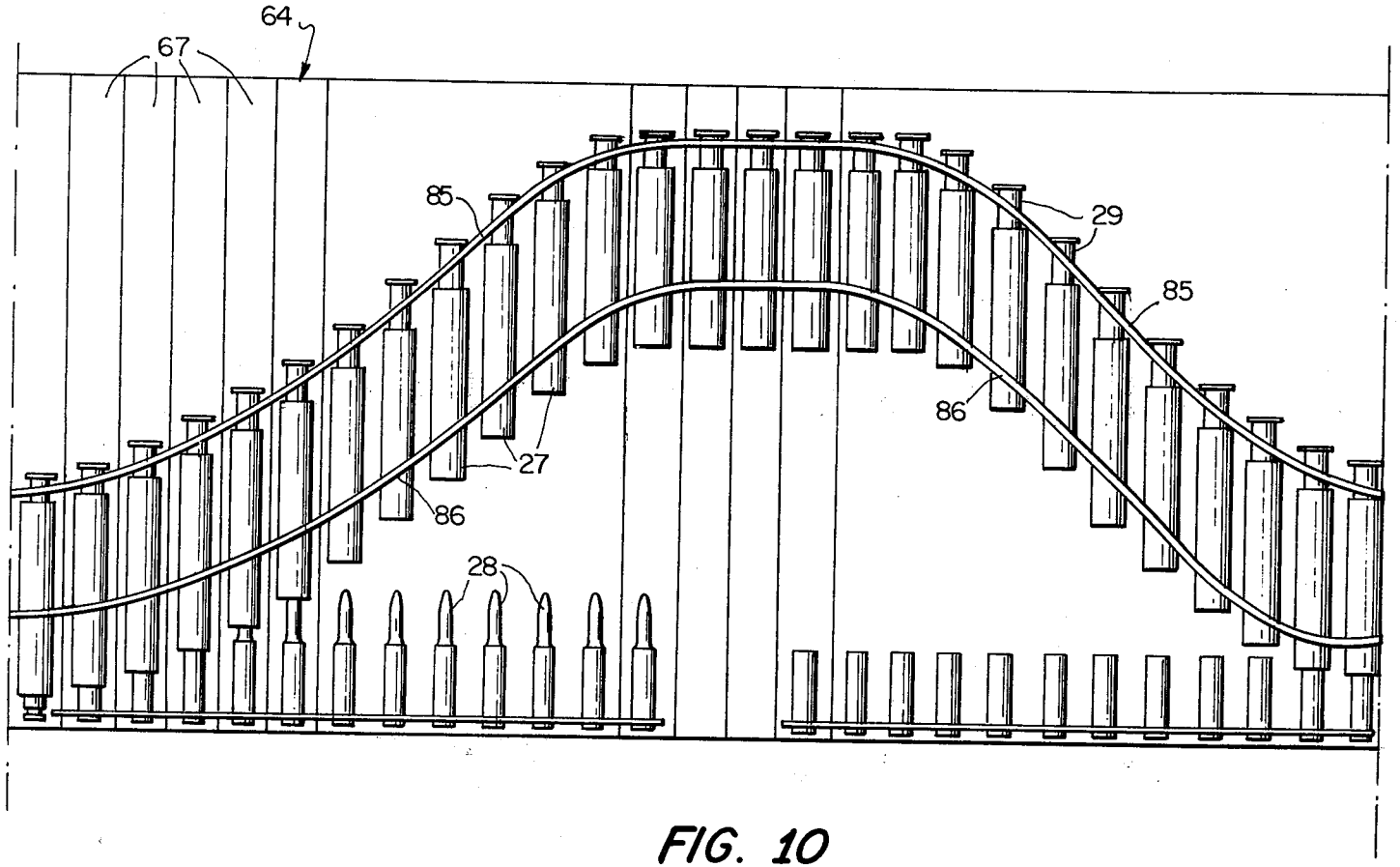
FIG. 10 is a schematic view illustrating the layout of the drum.

With particular reference to FIGS. 4 and 10, a segmental retaining member 80 is mounted on the side wall of the main housing 33 and the upper portion of such retaining member extends from one side of the drum to the other. The retaining member 80 includes a downwardly extending flange 81 located in spaced relationship with the periphery of the drum 64 and in a position to engage the extractor groove 82 which is located adjacent one end of each of the shells 28. When the ammunition belt 26 is placed on the drum by the rear interface unit, the extractor grooves 82 of the shells 28 engage the flange 81 so that the shells travel in a relatively straight path of movement around the upper portion of the drum.

An arcuate cam bar 85 is mounted within the housing 33 in spaced relationship to the drum 64 and such cam bar has one end located adjacent to the upper portion of the rear interface unit 59. The main portion of the cam bar extends substantially entirely around the drum so that the opposite end terminates adjacent to the lower groove 62 of the rear interface unit. Spaced from and generally parallel with the cam bar 85 is a hold-down bar 86 which engages the tubular members 27 and retains such members within the flutes or cradles 67 of the drum. The end of the cam bar 85 adjacent to the rear interface unit is substantially in alignment with the reduced groove 29 of the tubular members 27 so that such cam bar is disposed within the grooves as the drum carries the tubular members through the housing. During the rotation of the drum, the edges of the grooves 29 of the tubular members engage the cam bar 85 and cause the tubular members to be moved axially away from the shells 28 during the first portion of rotation of the drum so that the shells are entirely free of the tubular members and such shells are supported within the flutes 67 of the drum by the flange 81 of the retainer bar 80. If desired, a hold-down bar (not shown) may be provided to assist in retaining the shells 28 within the flutes.

Figure 9:
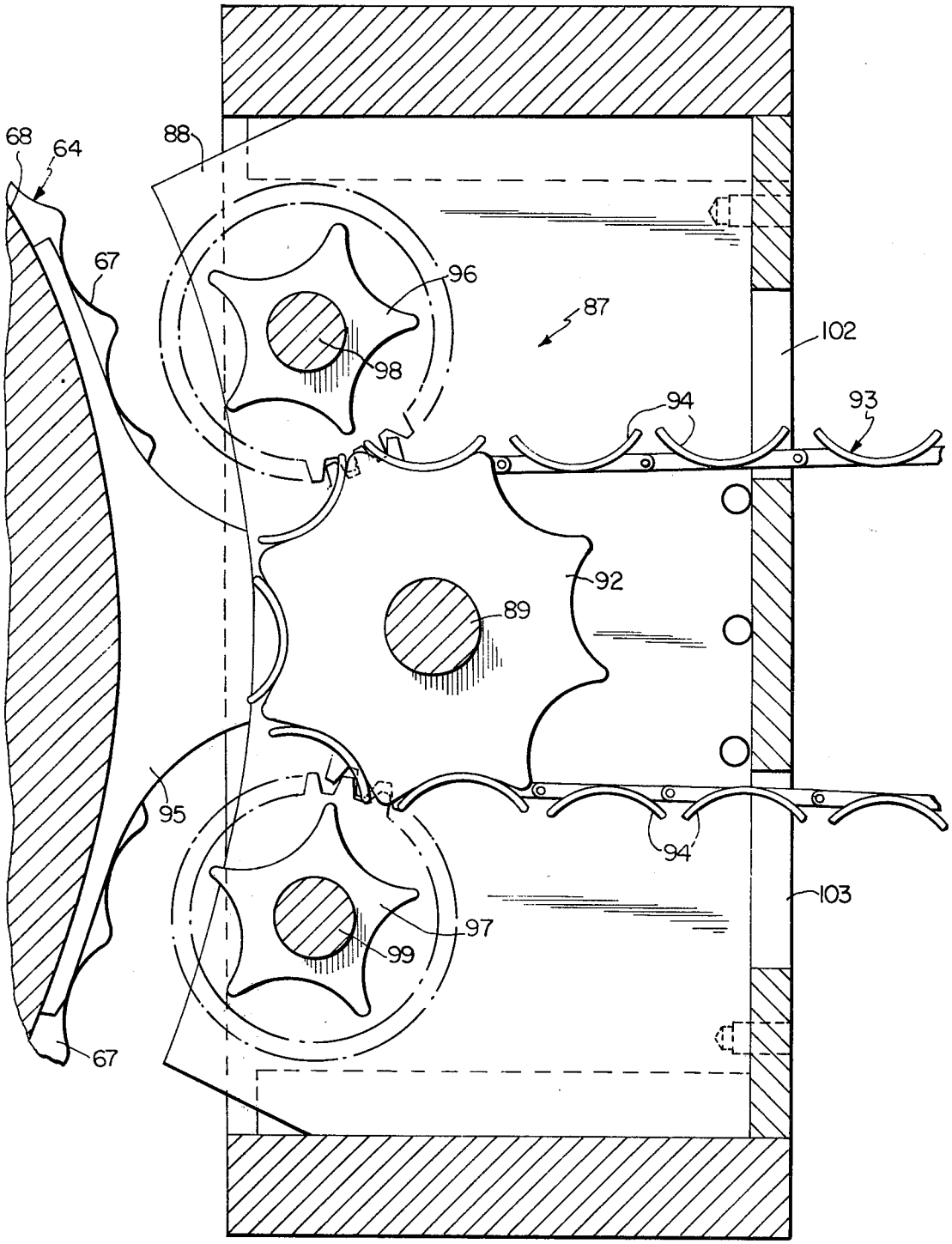
FIG. 9 is an enlarged sectional view taken on the line 9–9 of FIG. 4 and illustrating the front interface unit.

A front interface unit 87 is mounted within the housing 33 on the side of the drum opposite the rear interface unit and such front interface unit includes a pair of side walls 88 (FIG. 9). A shaft 89 is rotatably carried by the side walls 88 and such shaft is adapted to be driven in any desired manner, as by a gear train 90 which in turn is driven from any convenient source of power such as a gear box 91 connected to the flexible shaft 45 to cause the shaft 89 to be rotated in timed relationship with the shaft 65 of the drum and the shaft 70 of the rear interface unit. Intermediate the side walls 88 of the front interface unit, one or more drive sprockets 92 are keyed or otherwise attached to the shaft 89 and such drive sprockets receive and drive an element conveyor 93. The conveyor 93 is of conventional construction and includes a plurality of cradles 94 of a size to clampingly receive the casings of the shells 28.

The front interface unit 87 includes a pair of Y-shaped partitions 95 the arms of which are slidably mounted within the annular grooves 68 of the drum and function as guides for removing the shells 28 from the flutes or cradles 67 of the drum. It is noted that the upper retaining bar 80 terminates in the area of the front interface unit. A pair of upper and lower star wheels 96 and 97 are mounted on shafts 98 and 99, respectively, which are rotatably carried by the side walls 88. In order to drive the star wheels 96 and 97, each of the shafts 98 and 99 is provided with a gear 100 which meshes with a gear 101 attached to the shaft 89 so that the star wheels 96 and 97 are driven in timed relationship with the drive sprockets 92 and the drum 64. The upper star wheels 96 are adapted to engage the casings of the shells 28 while the shells are still carried by the drum 64 and move such shells along the partition 95 until they are subsequently inserted into the cradles 94 of the element conveyor.

In order to remove the shells 28 from the main housing 33, the front wall of such housing is provided with a pair of vertically spaced openings 102 and 103 for the egress and ingress of the element conveyor 93. An auxiliary housing 104 is mounted on the front wall of the main housing in a position surrounding the openings 102 and 103 and such auxiliary housing may include a window or transparent panel 105 which serves as an inspection station. The opposite end of the auxiliary housing is connected by a pair of flexible chutes 106 and 107 to an aircraft interface unit or load head 108 of conventional construction. The element conveyor 93 carries live shells through the flexible chute 106 to the aircraft interface unit 108 which is located in proximity to the armament system of the aircraft. Within the aircraft interface unit the shells are removed from the element conveyor and are inserted into the aircraft armament system, while simultaneously empty shell casings and misfired rounds are removed from the aircraft armament system and are inserted into the cradles 94 of the element conveyor for return to the main housing 33.

The aircraft interface unit may be supported in a position contiguous to the armament system of the aircraft in any desired manner, such as by mounting the interface unit on one end of a counterbalanced beam which is attached to a universal pivot carried by the frame 21. As illustrated, an elongated tongue 109 is pivotally connected to the frame 21 and the outer end of such tongue is provided with a generally vertically disposed sleeve 110 which slidably receives one end of a support rod 111. The opposite end of the support rod is connected to the aircraft interface unit 108 in any desired manner, as by welding or the like. A fluid cylinder 112 is carried by the sleeve 110 and such cylinder has a piston rod 113 the outer end of which is attached to the support rod 111 so that operation of the cylinder 112 causes the support rod 111 and the aircraft interface unit 108 to be raised and lowered.

When the element conveyor 93 returns the empty shell casings and misfired rounds to the front interface unit 87, the lower star wheel 97 removes the same from the cradles 94 and carries such shell casings along the Y-shaped partitions 95 and places such casings on the cradles 67 of the drum 64. The second portion of the segmental retaining bar 80 is disposed below the drum in a position that the flange 81 engages the extractor grooves of the shells so that the shells and misfired rounds travel in a relatively straight path of movement around the lower portion of the drum. If desired, a support bar (not shown) may be provided along the lower portion of the drum to retain the shell casings within the flutes or cradles 67. After the shell casings have been placed on the cradle of the drum, the drum continues to rotate. At the lower portion of the drum the cam bar 85 engages the reduced groove 29 of the tubular members and causes such tubular members to move axially of the cradles 67. Since the shell casing and misfired rounds are in axial alignment with the tubular members 27, such shells and misfired rounds are received within the tubular members. Thereafter the lower star wheel 74 of the rear interface unit removes the belt 26 from the drum 64, after which the belt drive wheel 46 pulls the belt through the flexible chute 54 and discharges the same into an empty ammunition box. Preferably one or more persons may arrange the belt in layers within the box as the belt is being discharged.

It will be understood that when the type of ammunition in the aircraft armament system is to be changed, the same procedure as described above is followed until an entire complement of shells is uploaded into the aircraft while empty shell casings, misfired rounds and unfired rounds are downloaded therefrom.

We claim:

1. An ammunition supply system for supplying ammunition to an armament system comprising a housing, drum means rotatably mounted within said housing, means for driving said drum means, said drum means having a plurality of flutes disposed generally parallel with the axis and arranged in side-by-side relationship around the entire periphery thereof, said drum having at least two spaced annular grooves disposed around the periphery thereof, first and second interface units in spaced relationship with one another adjacent the sides of said drum means, each of said interface units having first and second spaced partition means, said first partition means having arm portions located within one of said grooves of said drum means and said second partition means having arm portions located within another of said grooves of said drum means, an ammunition belt including a plurality of tubular members, flexible means connecting said tubular members in spaced generally parallel relationship with each other, each of said tubular members normally receiving a round of ammunition with one end of the ammumition extending outwardly therefrom, said first interface unit having a first transfer means for placing said tubular members and said rounds of ammunition within the flutes adjacent to one end of said drum means, cam means positioned within said housing and in spaced relationship to said drum means, said cam means extending substantially entirely around said drum means, said cam means engaging said tubular members and moving said tubular members axially away from said rounds of ammunition so that said rounds of ammunition and said tubular members are in axially spaced relationship with each other on said drum means, said first and second partition means of said second interface unit removing said rounds of ammunition from said drum means while said tubular members remain on said drum means, second transfer means, said second transfer means including a pair of rotating guide means disposed on opposite sides of said first and second partition means adjacent to said arm portions and a central rotating drive means mounted therebetween, said rotating guide means cooperating with said partition means and said central rotating drive means for transferring said rounds of ammunition from said second interface unit to the armament system while simultaneously removing the empty shell casings from the armament system and placing said empty shell casings within said flutes of said drum means so as to be in substantial axial alignment with said tubular members, said cam means moving said tubular mean axially of said shell casings to that the tubular members receive said shell casings, said first transfer means of said first interface unit simultaneously removing said tubular members and shell casings from said drum means as said tubular members and said rounds of ammunition are placed within the flutes of said drum means, and means for discharging said tubular members from said housing.

2. The invention of claim 1 in which said arm portions of each of said first and second partition means are outwardly diverging so as to extend in substantially opposite directions relative to one another within said grooves.

3. The invention of claim 1 in which said central rotating drive means includes a sprocket having grooves and teeth therein, said empty shell casings being seated within said grooves as said empty shell casings are removed from said armament system, said pair of rotating guide means including a first star wheel for removing said empty shell casings from said grooves of said sprocket, said first star wheel having a series of teeth which are spaced in closer radial proximity to one another than are said teeth of said sprocket whereby the distance between the empty shell casings is reduced after the empty shell casings are removed from said sprocket.

* * * * *